US006431403B1

(12) United States Patent
Davis

(10) Patent No.: US 6,431,403 B1
(45) Date of Patent: Aug. 13, 2002

(54) BEVERAGE DISPENSE SYSTEM

(75) Inventor: Terrence Robert Davis, Worcester (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/838,925

(22) Filed: Apr. 20, 2001

(51) Int. Cl.[7] ..... B67D 5/62
(52) U.S. Cl. ..... 222/146.6; 62/390
(58) Field of Search ..... 222/146.6, 394, 222/399; 62/390, 393, 396

(56) References Cited

U.S. PATENT DOCUMENTS 4,094,445 A * 6/1978 Bevan ..... 222/146.6
5,009,082 A * 4/1991 Abraham, III ..... 222/146.6
5,732,856 A * 3/1998 Fry ..... 222/146.6

* cited by examiner

*Primary Examiner*—Philippe Derakshani
*Assistant Examiner*—Thach H Bui
(74) *Attorney, Agent, or Firm*—Sten Erik Hakanson

(57) ABSTRACT

In one aspect the present invention provides a chilled beverage dispense system including a beverage recirculation loop and a glycol recirculation loop, a first chiller to cool the beverage and a second chiller to cool the glycol, a heat exchanger through which the cooled beverage and the cooled glycol are passed to further cool the beverage and a dispense valve located in the beverage recirculation loop downstream of the heat exchanger. The glycol recirculation loop including a bypass valve upstream of the heat exchanger, whereby in a standby, non-dispense mode the glycol bypasses the heat exchanger and when a beverage dispense is required, the glycol is diverted through the heat exchanger.

1 Claim, 3 Drawing Sheets

19
28
21
22
28
18
30
20
29
17
43
16
24
16
B
B
48
A
A
32
41
23
41
47
31
28
11
33
13
12
27
25
26
24
25
49
42
15
46
14
13
16
44
10
45
40

19
28
21
22
28
30
18
20
29
17
43
16
28
16
24
B
B
50
50
48
A
A
41
32
47
41
23
31
28
11
33
13
12
27
25
24
25
49
15
42
46
14
16
13
44
10
45
40

BEVERAGE DISPENSE SYSTEM

BACKGROUND

This invention relates to a beverage dispense system in which a chilled beverage is presented to the consumer. It is particularly applicable to beverages such as beer or lager.

Conventional beer/lager cooling systems typically have a bulk beverage supply located at a separate location (called a cellar room) from the bar counter and the beverage is chilled in the cellar by being passed through an ice bank cooler to a temperature just below its ultimate dispense temperature. The chilled beverage is then pumped from the cellar room to the bar within an insulated python.

If one wishes to dispense the beverage at very cold temperatures e.g. below 0° C., such a system has problems. In particular, one has to chill the beverage in the cellar room to an even lower temperature. Whilst one can utilize glycol mixtures in the ice bank cooler instead of water to obtain lower beverage temperatures, the lower the required beverage temperature the greater the risk that it will freeze solid in the cooler or the python during periods when the beverage is not being dispensed. It will then be impossible to operate the dispense system when the next drink is required to be dispensed.

It is an object of the invention to provide a system which is capable of successfully dispensing a chilled beverage from a bulk supply to a temperature close to the freezing point of the beverage.

SUMMARY OF THE INVENTION

Accordingly in one aspect the invention provides a chilled beverage dispense system including a beverage recirculation loop and a glycol recirculation loop, a first chiller to cool the beverage and a second chiller to cool the glycol, a heat exchanger through which the cooled beverage and the cooled glycol are passed to further cool the beverage and a dispense valve located in the beverage recirculation loop downstream of the heat exchanger, the glycol recirculation loop including a bypass valve upstream of the heat exchanger, whereby in a standby, non-dispense mode the glycol bypasses the heat exchanger and when a beverage dispense is required, the glycol is diverted through the heat exchanger.

In another aspect the invention provides a method of dispensing a cooled beverage in which the beverage is passed in a recirculation loop through a first chiller to cool it and then through a heat exchanger and then via a dispense head to return to the first chiller, a glycol coolant is passed in a recirculation loop through a second chiller to a bypass valve to avoid passing through the heat exchanger when beverage is not being dispensed and then back to the second chiller, the bypass valve being actuated when a dispense is required whereby the glycol coolant passes through the heat exchanger to further cool the beverage before it is dispensed.

It will be appreciated, therefore, that the beverage can be maintained in its first cooled condition, e.g. from 0.5° to 1.5° C., typically 1° C., in the standby mode by means of recirculation through its first chiller but that when dispense is required it is further cooled by heat exchange within the heat exchanger with the colder glycol that is now diverted from its bypass mode to flow through the heat exchanger. The glycol may be maintained at, e.g. from −8.5° to −9.5° C., typically −9° C., to give a second cooling to the beverage which may then be dispensed at e.g. from 4° to −5° C., typically −4.5° C. It will be appreciated that these ranges will vary depending on the beverage to be dispensed.

The heat exchanger may be of any convenient plate, tube or other construction.

During standby mode, glycol remaining in the heat exchanger will, of course, warm up from its chilled temperature but will be maintained at about the temperature of the recirculating beverage.

If the heat exchanger is located close to the dispense valve so that the amount of beverage at any point in time from the heat exchanger to the dispense valve is small relative to the amount to be dispensed, it may be possible to arrange a control system that commences dispense at the same time as operating the bypass valve to divert the glycol through the heat exchanger. However, it is preferred that a control system be used that, on a dispense being actuated, first operates the bypass valve to further cool the beverage and then, after a delay, opens the dispense valve. The delay may be a predetermined time or may be determined by a temperature sensor for the beverage positioned between the heat exchanger and the dispense valve. In this latter embodiment, the dispense valve will only open once the temperature sensor indicates to the control system that the required dispense temperature has been reached.

The glycol coolant used may be pure glycol but will usually be a water/glycol mixture, e.g. of proportions from 25:75 to 50:50, depending on the degree of cooling required.

In a preferred embodiment a water recirculation loop is included in the system in order to provide a spray of chilled water onto a glass or other receptacle into which the beverage is to be dispensed. The water may conveniently be chilled in the same first chiller used for the beverage recirculation loop. This first chiller may be a single ice bank cooler of conventional design with a portion of the beverage recirculation loop and of the water recirculation loop immersed in water/ice within the cooler.

A water dispense valve is provided in the water recirculation loop and controlled quantities of chilled water at from, e.g. 0.5° to 1.5° C., may be sprayed onto the beverage receptacle in response to signals from the beverage dispense control system. The receptacle may be sprayed before, during and/or after beverage is dispensed into it.

The invention provides a system in which cooler than usual beverage can be dispensed safely and without risk of freezing. A conventional ice bank cooler can be used for the initial cooling (first chiller) and to maintain the cooled effect between dispenses and the heat exchanger is used to provide the extra cooling when required for a dispense. Between dispenses the heat exchanger is bypassed by the recirculating glycol coolant and the system "idles" with the beverage at the temperature achieved by the first chiller.

The dispense valve can be permanently chilled in the beverage recirculation loop and so does not harmfully affect dispense temperature after standing unused.

DESCRIPTION OF THE DRAWINGS

A better understanding of the structure, function, operation, and advantages of the present invention can be had by reference to the Detailed Description that is set out below and that refers to the following drawing figures, wherein.

DETAILED DESCRIPTION OF THE PREFERRED EMBODIMENTS

Figure 1:
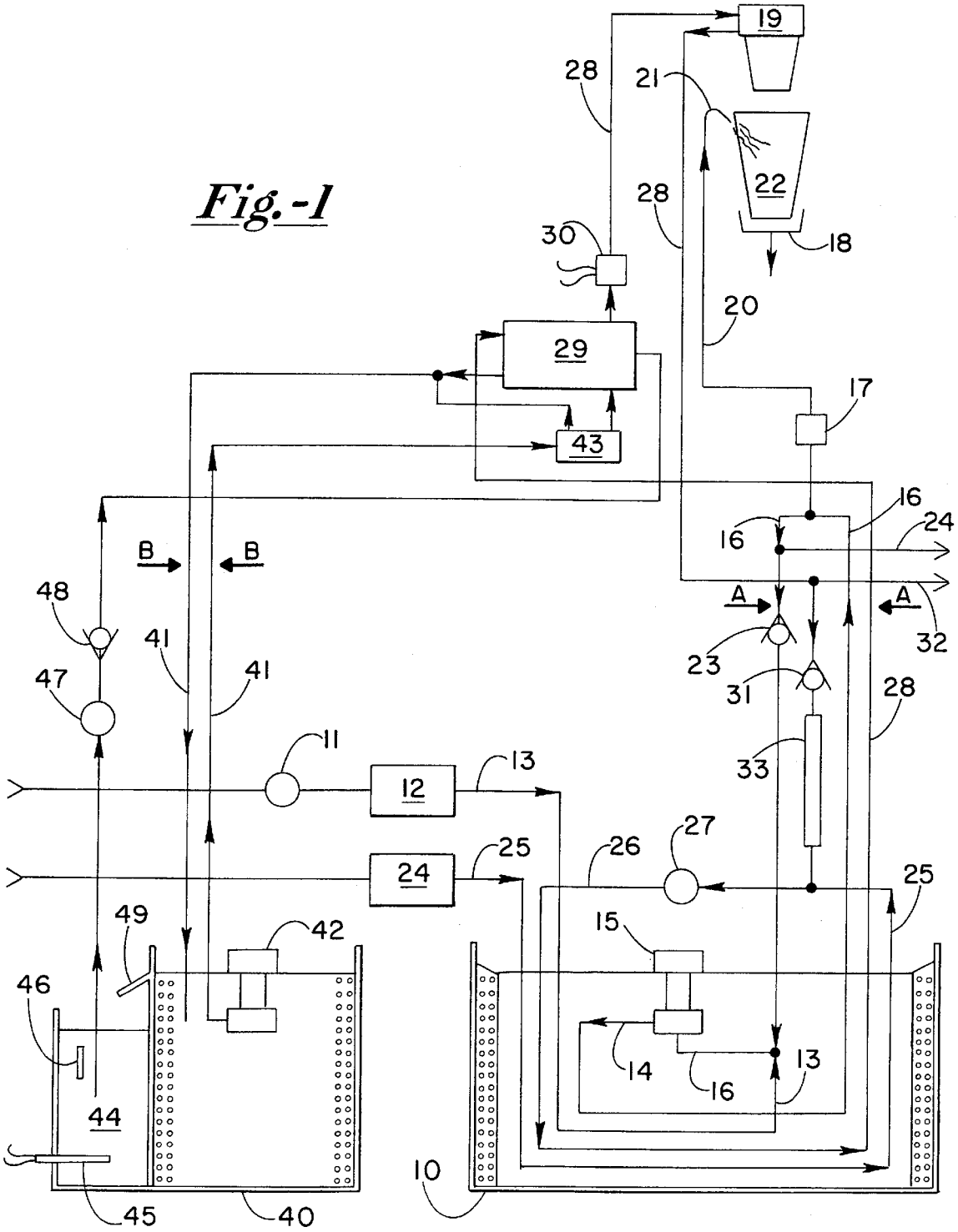
FIG. 1 is a schematic illustration of a beverage dispense system of the present invention.

In FIG. 1 a first chiller 10, which is an ice bank cooler, contains portions of recirculation loops for water and for a beverage. The water flow is indicated by block headed arrows and the beverage flow by line headed arrows.

The water flows from a source (not shown), e.g. the mains, via an optional boost pump 11 and a pressure regulator 12 into an outer water loop 13 in chiller 10 which continues into an inner water loop 14. Loop 14 includes a recirculation pump 15. Cooled water from inner loop 14 is pumped from chiller 10 around a recirculation loop 16. A solenoid valve 17, adjacent a rotatable turntable 18 underneath a beverage dispense head 19, is connected to loop 16 but is closed in the idle, non-dispense mode. A water line 20 leads from the solenoid valve to a spray head 21 through which cooled water may be sprayed onto a glass 22 underneath the dispense head 19 when solenoid valve 17 is opened. In the idle mode, the water returns to chiller 10 via an optional non-return valve 23 and continues to circulate around its inner loop 14 and its recirculation loop 16. The water in outer loop 13 in chiller 10 is standing water while valve 17 is closed. When valve 17 is opened to commence spraying of the glass water pressure from its source, boosted if required by pump 11, introduces fresh water via loop 13 into loops 14 and 16.

An optional bleed line 24 is connected into recirculation loop 16.

Beverage flows from a source (not shown) via metering turbine 24 into an outer beverage loop 25 which passes through chiller 10 and out again where it joins an inner loop 26. Loop 26 passes through a recirculating pump 27 and then back into the chiller. If desired a flow turbine may be included in this loop 26, e.g. between pump 27 and the junction of loops 25 and 26.

The cooled beverage leaves chiller 10 in a recirculation loop 28 and passes through a heat exchanger 29. On leaving heat exchanger 29, where in dispense mode it is further cooled by a glycol line to be described below, the beverage passes through a temperature sensor 30, e.g. a thermistor housing, and from there through dispense head 19 and via a non-return valve 31 to the chiller 10. Between non-return valve 31 and chiller 10 the beverage passes through a restrictor tube or compensator valve 33 to control the speed of beverage recirculation to prevent, e.g. decarbonation. The recirculation speed may be kept, for example, to about 1½ liters per minute, which is a typical dispense rate. Restrictor 33 may be dispensed with if the above-mentioned optional flow turbine is used in conjunction with pump 27 to control the flow speed. If the system remains in idle mode without dispense for some time, predetermined, the speed of beverage circulation may be reduced. It may then be speeded up again for dispense and for a period after dispense to maintain the desired temperature. The beverage continues to be recirculated around its loop 28 and inner loop 26 in the idle mode. The beverage in outer loop 25 is standing beverage during the idle mode but when the dispense head 19 is operated to dispense into glass 22, fresh beverage flows into loops 25 and 26 from the source.

A bleed line 32 is connected into recirculation loop 28.

The water and beverage recirculation lines may be contained within a conventional python and may conveniently be contained in a single python for a substantial portion of their lengths. This single python line is indicated generally by arrows AA.

The glycol coolant is cooled in chiller 40 and is circulated around a recirculation loop 41 by pump 42. The glycol flow is indicated by block headed arrows plus line headed arrows. From chiller 40 the glycol travels to bypass valve 43 adjacent heat exchanger 29. In the idle, non-dispense state the glycol bypasses the heat exchanger and returns to chiller 40 for recirculation. The recirculation lines of loop 41 may also be contained within a conventional python, indicated generally by arrows BB. When the bypass valve 43 is opened the glycol flow is diverted through the heat exchanger where it causes further cooling of the beverage passing through in its loop 28.

Glycol chiller 40 has an overflow reservoir 44 whose purpose will be described in more detail below. Reservoir 44 contains a heating element 45 and a thermostat 46. Glycol from reservoir 44 can be pumped by pump 47 and non-return valve 48 into the heat exchanger 29 from where it leaves in the glycol recirculation loop 41 to return to chiller 40.

One possible routine for operation of the dispense system is now described.

In the idle, non-dispense situation the beer and water are recirculating through their recirculation loops at about, say, 1° C. The glycol is recirculating in its loop, missing out the heat exchanger 29, at about, say, −9° C.

A glass 22 is placed on turntable 18 and the control unit (not shown) is pressed to select a ½ pint or 1 pint dispense of the beverage.

This actuates the bypass valve 43 which diverts glycol in its recirculation loop to pass through the heat exchanger to further cool the beverage. Solenoid 17 is also actuated and cold water is sprayed via head 21 onto the glass 22. The turntable 18 motor mechanism (not shown) is also started so that glass 22 rotates on the turntable.

Thermistor 30 is sensing the beer temperature as it leaves the heat exchanger 29 and, when it signals that the desired dispense temperature has been reached, the dispense valve in dispense head 19 is opened to allow the cooled beverage to be dispensed into the glass. The metering turbine 24 is actuated by the flow of beer in from the source to replace dispensed beer and the water spray and turntable rotation are maintained as dispense continues.

If desired, during dispense an ultrasonic shock can be given to the beverage in the glass on the turntable at a predetermined point of the dispense as indicated by the metering of turbine 24. This can improve the appearance and presentation of the beverage in the glass e.g. by assisting in the generation of a foamed head on the beverage. Means to provide such a shock are not shown here but are known in the art. The water solenoid 17 closes at another predetermined point of the metered dispense. The glycol bypass valve 43 is switched to stop further cooling, again at a predetermined point of the metered dispense, usually towards the end of the metered dispense. As bypass valve 43 is so switched, the glycol pump 47 is actuated to provide a timed flow, e.g. of from 4 to 5 seconds, at about 0.5 liters/minute, of glycol warmed by heater 45 to about, say, 8° C. through the heat exchanger 29. This is just a sufficient amount of heat glycol to flush colder glycol from the heat exchanger and thereby prevents the risk of beverage freezing in the heat exchanger when the dispense has finished. (It will be appreciated that the bypass arrangement prevents the heat exchanger from getting too cold during periods of no dispense which would also have the risk of beverage freezing.).

A second ultrasonic shock may be administered to the beverage in the glass just before or at the end of the dispense to nucleate the beverage for final appearance.

When metering turbine 24 indicates that the required amount of beverage has been dispensed, the control system closes the dispense valve at the dispense head. The turntable may be timed to continue to rotate for a preset but adjustable time after dispense is finished. The water solenoid valve 17 can be re-opened after a preset but adjustable time to provide a further spray onto the exterior of the glass for a short time, e.g. 2 or 3 seconds, to clear condensation on the glass as the ice crystal nucleation occurs in the beverage. This water spray and the turntable rotation then conveniently stop to bring the dispense cycle to an end. The system then reverts to its stable, idle mode.

When the glycol from reservoir 44 is returned to chiller 40, this excess volume of glycol in the chiller overflows through overflow pipe 48 into reservoir 44 to maintain the normal level of glycol in the chiller.

Figure 3:
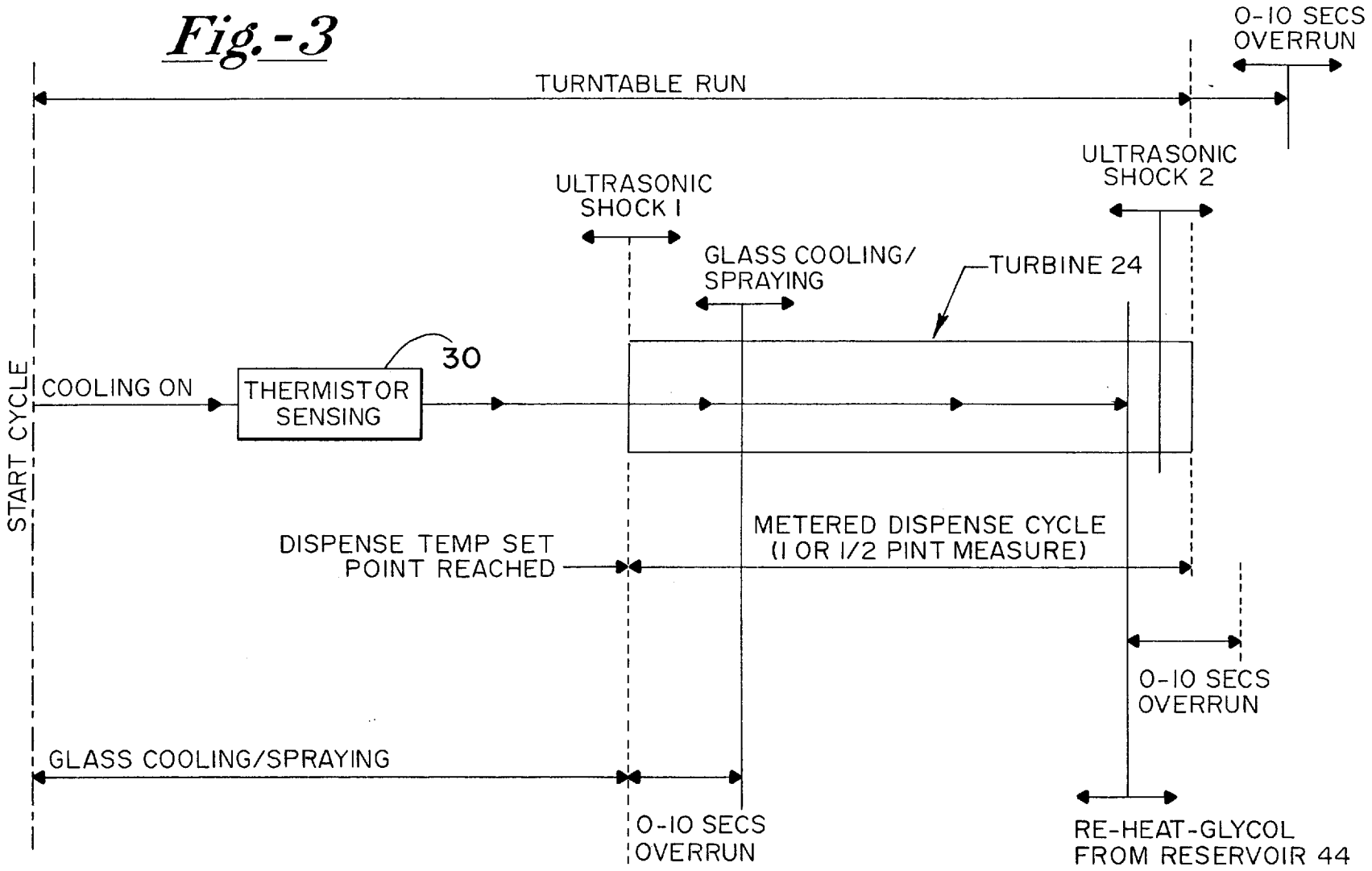
FIG. 3 is a diagrammatic representation of possible sequences in time.

The above routine is illustrated diagrammatically in FIG. 3. It will be appreciated that the routine may be varied in a number of respects, particularly in respect of the timings, e.g. of the glass spraying stages, the ultrasonic shocks and the turntable over run at the end of the dispense.

Figure 2:
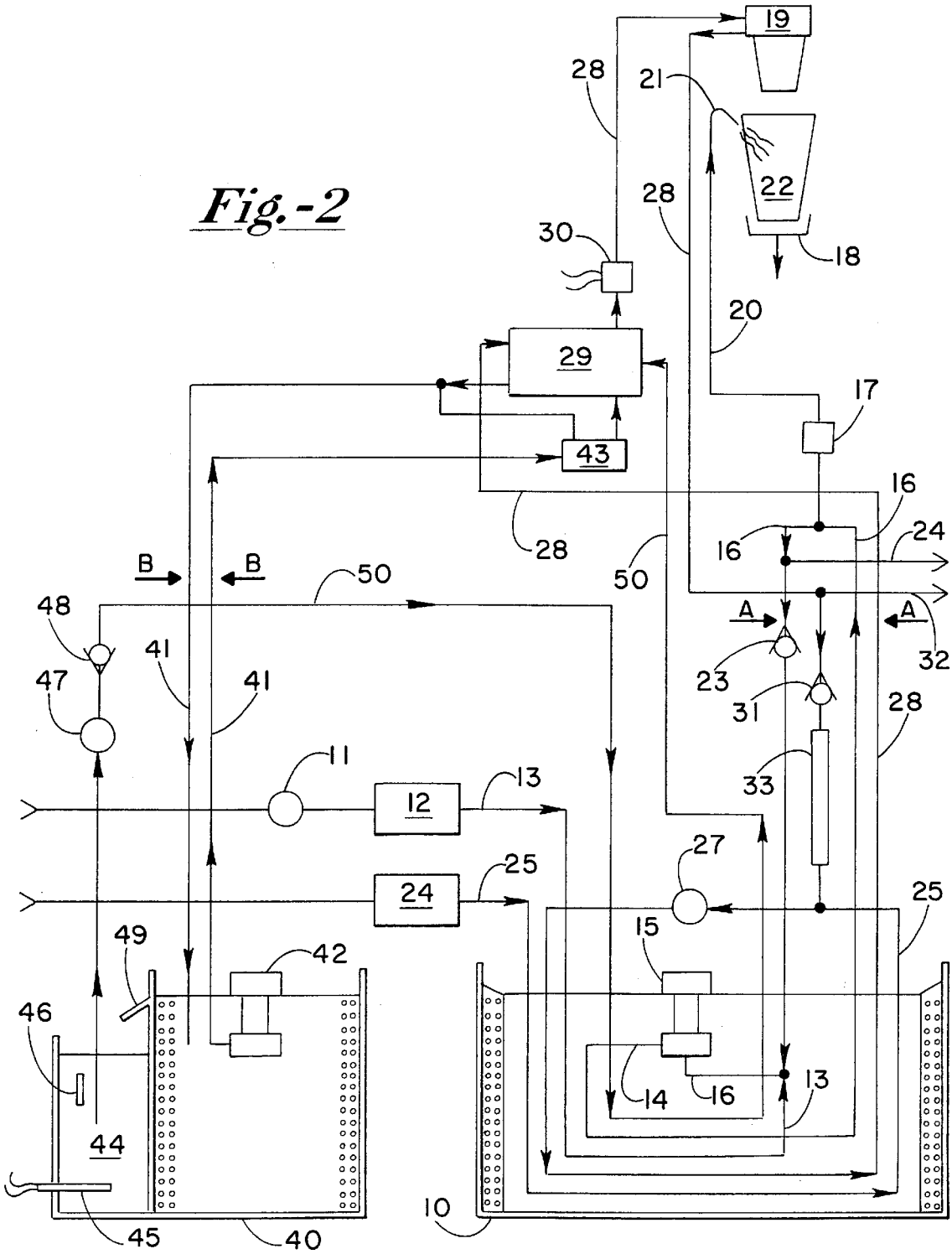
FIG. 2 is a similar illustration to FIG. 1 of a modified system of the present invention.

In FIG. 2 is shown a modification of the system of FIG. 1. Like parts have been given the same reference numerals and will not all be described again in detail here.

The beverage and water chiller and recirculation loops are the same as in FIG. 1 and the pumping, monitoring and metering means are also the same as are the heat exchanger and dispense head/turntable arrangements.

The glycol recirculation loop, chiller and reservoir arrangements are also the same but the heated glycol line from the reservoir to the heat exchanger takes a different route. In the FIG. 2 arrangement, instead of the warmed glycol from reservoir 44 being pumped directly to heat exchanger 29 it is now pumped to the heat exchanger via a glycol line 50 which passes through chiller 10 before reaching the heat exchanger. This is to bring the glycol to the same temperature as the recirculating beverage before it passes into the heat exchanger. As indicated a portion of glycol line 50 may be accommodated in the python AA for the water and beverage recirculation loops. Otherwise, the operation of the glycol line to the thermostat is the same as described above with reference to FIG. 1.

It will be appreciated that many further modifications are possible within the scope of the present invention. For example, chillers 10 and 40 may conveniently be positioned in a single housing.

In the unlikely event of the system freezing at some point, this may be detected by an optional turbine, e.g. the optional flow turbine referred to in conjunction with pump 27 above. This turbine by indicating no flow when flow is expected can signal to the control to shut down the system for investigation.

What is claimed is:

1. A chilled beverage dispense system including a beverage recirculation loop and a glycol recirculation loop, a first chiller to cool the beverage and a second chiller to cool the glycol, a heat exchanger through which the cooled beverage and the cooled glycol are passed to further cool the beverage and a dispense valve located in the beverage recirculation loop downstream of the heat exchanger, the glycol recirculation loop including a bypass valve upstream of the heat exchanger, whereby in a standby, non-dispense mode the glycol bypasses the heat exchanger and when a beverage dispense is required the glycol is diverted through the heat exchanger.

* * * * *